US008490297B2

(12) United States Patent
Guerra

(10) Patent No.: US 8,490,297 B2
(45) Date of Patent: Jul. 23, 2013

(54) INTEGRATED, CUMULATIVE-FORCE-MITIGATING APPARATUS, SYSTEM, AND METHOD FOR SUBSTANTIALLY-INCLINED SHOES

(76) Inventor: Ginger Guerra, North Bergen, NJ (US)

( * ) Notice: Subject to any disclaimer, the term of this patent is extended or adjusted under 35 U.S.C. 154(b) by 1262 days.

(21) Appl. No.: 12/287,593

(22) Filed: Oct. 10, 2008

(65) Prior Publication Data

US 2009/0094856 A1 Apr. 16, 2009

Related U.S. Application Data

(60) Provisional application No. 60/998,514, filed on Oct. 11, 2007.

(51) Int. Cl.
*A43B 13/20* (2006.01)
*A43B 13/18* (2006.01)
*A43B 21/26* (2006.01)

(52) U.S. Cl.
USPC ..... 36/29; 36/28; 36/35 R

(58) Field of Classification Search
USPC ..... 36/28, 29, 35 R, 36 R, 37, 88
See application file for complete search history.

(56) References Cited

U.S. PATENT DOCUMENTS 1,841,942 A * 1/1932 Fenton ..... 36/145
2,502,774 A * 4/1950 Alianiello ..... 36/28
2,760,281 A 8/1956 Cosin
4,123,855 A 11/1978 Thedford
4,472,890 A 9/1984 Gilbert
4,567,677 A 2/1986 Zona
4,610,099 A 9/1986 Signori
4,876,805 A 10/1989 Peoples
5,097,607 A 3/1992 Fredericksen
5,155,927 A 10/1992 Bates et al.
D353,710 S 12/1994 Brazzell
5,435,078 A * 7/1995 Pyle ..... 36/30 R
5,493,792 A 2/1996 Bates et al.
5,701,687 A 12/1997 Schmidt et al.
5,718,063 A 2/1998 Yamashita et al.
5,878,510 A 3/1999 Schoesler
5,979,086 A 11/1999 Vindriis
5,993,585 A 11/1999 Goodwin et al.
D426,118 S 6/2000 Thomas
6,092,310 A 7/2000 Schoesler
6,138,382 A 10/2000 Schoesler
6,176,025 B1 * 1/2001 Patterson et al. ..... 36/28
6,391,405 B1 5/2002 Bonk et al.

(Continued)

OTHER PUBLICATIONS

International Preliminary Report on Patentabitity for Int'l Patent App. No. PCT/US09/005561; Apr. 21, 2011 (10 pgs).

(Continued)

*Primary Examiner* — Jila M Mohandesi
*Assistant Examiner* — Sharon M Prange
(74) *Attorney, Agent, or Firm* — Ater Wynne LLP

(57) ABSTRACT

A force-responsive, bladder filled with a flowable, non-gaseous material, and disposed mainly within a recess having an opening presented at a foot-engaging surface of a substantially-inclined, aesthetically-oriented shoe. A compliant, resilient lamina is typically disposed at the foot-engaging surface, overlying at least a portion the opening. In response to a force applied by a user's foot, the bladder deforms both downwardly away from relatively projecting and/or relatively unyielding, pressure-applying portions of the foot, and upward toward other portions of the foot, providing conformal support to the contour of user's foot and attenuating the effects of cumulative forces incurred by the foot.

21 Claims, 4 Drawing Sheets

U.S. PATENT DOCUMENTS

| | | | | |
|---|---|---|---|---|
| 6,443,986 | B1 | 9/2002 | Malice, Jr. et al. | |
| 6,457,263 | B1 | 10/2002 | Rudy | |
| 6,796,056 | B2 | 9/2004 | Swigart | |
| 6,948,263 | B2 * | 9/2005 | Covatch | 36/30 R |
| 6,976,321 | B1 | 12/2005 | Lakic | |
| 7,073,276 | B2 | 7/2006 | Swigart | |
| 7,086,179 | B2 | 8/2006 | Dojan et al. | |
| 7,086,180 | B2 | 8/2006 | Dojan et al. | |
| 7,131,218 | B2 | 11/2006 | Schindler | |
| 7,141,131 | B2 | 11/2006 | Foxen et al. | |
| 7,216,443 | B2 | 5/2007 | Baden et al. | |
| 7,243,443 | B2 | 7/2007 | Swigart | |
| 7,249,425 | B2 | 7/2007 | Wang | |
| 7,377,056 | B2 | 5/2008 | Snow et al. | |
| 7,484,318 | B2 * | 2/2009 | Finkelstein | 36/44 |
| 7,526,880 | B2 * | 5/2009 | Polcek | 36/44 |
| 2004/0211087 | A1 | 10/2004 | Scott | |
| 2005/0027025 | A1 | 2/2005 | Erb et al. | |
| 2005/0086838 | A1 | 4/2005 | Khantzis | |
| 2005/0132611 | A1 | 6/2005 | Polcek | |
| 2006/0026867 | A1 | 2/2006 | Polcek | |
| 2006/0086005 | A1 | 4/2006 | Yerian | |
| 2007/0151124 | A1 * | 7/2007 | Chan | 36/35 R |

OTHER PUBLICATIONS

International Search Report and Written Opinion for Int'l Patent App No. PCT/US09/05561 dated Jan. 14, 2010 (13 pages).

* cited by examiner

INTEGRATED, CUMULATIVE-FORCE-MITIGATING APPARATUS, SYSTEM, AND METHOD FOR SUBSTANTIALLY-INCLINED SHOES

RELATED APPLICATIONS

This application claims the benefit of priority to U.S. Provisional application No. 60/998,514, filed on 11 Oct. 2007 and entitled BUILT-IN LIQUID, SILICONE OR GEL INSOLE FOR PLATFORM SHOES, the contents of which are hereby incorporated herein in their entirety by this reference.

FIELD OF THE INVENTION

The invention relates generally to the field of shoe construction. More particularly, the invention relates to materials, structures, and methods for providing a shoe with resilient structures integrated with the sole thereof, the materials and structures being so configured and positioned relative the sole as to enhance comfort and mitigate fatigue in the foot of a user.

BACKGROUND OF THE INVENTION

Feet are, without doubt, the unsung heroes of human anatomy. They literally carry us on their backs, through thick and thin, and as a result, feet suffer untold abuse during the course of human activities. Indeed, shoes were likely invented by primitive man to protect their feet from crippling injuries, and thereby to increase the duration and/or the vigor of their daily adventures. Such protection could literally mean the difference between life and death. As human experience progressed, and activities varied, so has our skill, innovation, and objectives with regard to shoe design and construction.

At some point in human history, shoes assumed alternative and/or dual roles as both functional items and objects of aesthetic expression. So thoroughly has this latter interest developed, that some modern shoes have completed a historical circuit. They are highly prized and sought out for their aesthetic qualities, in spite of their tendency to inflict pain and injury upon the user's feet.

For some activities, for example for industrial work and/or athletics, shoes mainly retain functional and injury-prevention purposes, and their construction, including design and materials, are suited primarily for those purposes. Advancements in knowledge and technology (e.g., material science, human anatomy and kinesiology, etc.) have led to the development of innovative shoe designs, construction, and materials, as well as staggering levels of use-based specialization in the same. So much so, that a shoe designed for a particular purpose (e.g., sprinting), can include numerous design, material, and construction variations depending upon such factors as the type of intended running surface, the morphological and kinesthetic characteristics and running style of the individual user, and even the expected weather conditions.

However, the evolution of the design and construction of shoes intended for primarily aesthetic (e.g., fashionable) purposes has followed a divergent and rather stunted path. Once established, aesthetics remains a primary selection criterion by a large segment of consumers, and therefore also the primary design consideration. This is true despite research showing that wearing shoes that dramatically affect posture, foot angle, balance, and other kinesthetic factors, can and does lead to improper anatomical alignment and physiological damage taking a host of forms.

Many (primarily women's) fashion shoes feature an elevated heel portion (e.g., high-heels, pumps, platforms, wedges, etc.), which produces a shoe that can be marginally, substantially, or even extremely inclined along its anterior-posterior axis. Further, many such shoes include relatively insubstantial uppers, designed for appearance and to merely hold their rather rigid sole to the user's foot, rather than to provide lateral stability and/or support to the foot during use. As a consequence of these features, the natural mechanics of the foot are constrained and compromised, and stresses during use are concentrated into relatively few, small portions of a user's foot. Namely, the "ball" of the user's foot, and to a somewhat lesser extent, the user's heel, are primarily affected, as the user's foot is forced into a plantarflexed condition.

A robust secondary market has developed for generically-designed products, each of which are insertable into a wide variety of shoes (e.g., replaceable, cushioned, full-foot shoe insoles, molded rigid orthotics, heel pads, etc.), to enhance comfort and/or provide, for example, orthopedic benefits. However, very few of these products are suitable for use in women's fashion shoes, such as those having an elevated heel and/or relatively open or otherwise minimally-enclosing upper portions. Inserts tend to shift position at the least, and fall out at the worst, all the while negatively affecting the aesthetics of the shoe. Further, shoe inserts tend to consume volume within the foot-receiving and retaining portion of most shoes, altering the fit and comfort of the shoe for the user.

Additionally, so-called 'gel' shoe inserts are typically formed of a soft, rubbery (e.g., flexible, resilient, etc.) material that exhibits limited compression when placed under a load. Once the 'gel' of the insole is compressed to or near its limit, a foot in contact therewith tends to 'bottom out'. That is to say, a gel insole which is compressed at or near its limit presents to a user's foot a rigid resistance to further notable foot-cushioning response. Thus, any shoe insert or other similar structure that 'bottoms out' under a load applied during normal use provides inadequate protection, and cumulatively does not mitigate the foot-fatiguing forces involved in normal use. Further, the so-called 'gel' inserts are uniformly unitary in construction, and exhibit no fluidic response to an applied force.

In certain athletic shoes, for example, gas-filled chambers (e.g., containing air or some other gaseous fluid) are provided within the thickness of a shoe sole, rather than as separate components, to obviate some of the discussed disadvantages. The compressibility of the gases confined within such chambers, combined with the compressibility and elasticity of surrounding, typically polymeric materials, provides cushioning to a user's foot, particularly to mitigate foot-strike forces during athletic activity. Examples of such structures and uses are described in a family of patents to one Swigart, including U.S. Pat. Nos. 6,796,056, 7,073,276, and 7,243,276, (collectively, the Swigart patents).

However, such gas-filled chambers are generally fully-integrated into shoes, rendering them relatively permanently affixed therein. Thus, when such gas-filled chambers are either penetrated, or wear out, or otherwise lose their hermetic properties, they thereafter fail to provide the intended benefits to the user, and are not replaceable. In such cases, the user typically replaces the shoes. More frequent shoe replacement is accepted in the case of athletic and other more aggressive use-type shoes, as it is well known that the materials lose their beneficial properties more quickly under such conditions, rendering the shoes ineffective for their intended purpose.

The above described situation is unlike the conditions under which more aesthetically-oriented shoes are generally used. Aesthetically-oriented shoes tend to remain fully-functional for a longer period of time, as they are typically used under less aggressive conditions, and also are used less frequently. The latter reason is true inasmuch as the typical user owns numerous different sets of aesthetically-oriented shoes, and uses them in alternation with each other, for example to match other articles of clothing or fashion accessories.

Additionally, the prior art, including the Swigart patents, neither expressly nor impliedly apply to fashion and other shoes having a notably elevated heel portion and/or a relatively rigid (e.g., inelastic) sole material and/or structure. Perhaps more particularly, the prior art does not apply to shoes which, unlike most athletic shoes, are generally not intended or utilized in a manner including running, jumping, rapid direction changes (high-lateral sheer forces between the foot and insole), and aggressive foot strikes. Therefore, despite such advancements in athletic shoe design, construction, and materials, the same is not true for women's fashion shoes, which have remained relatively unchanged for decades, if not longer.

DETAILED DESCRIPTION OF THE PREFERRED EMBODIMENTS

Figure 1A:
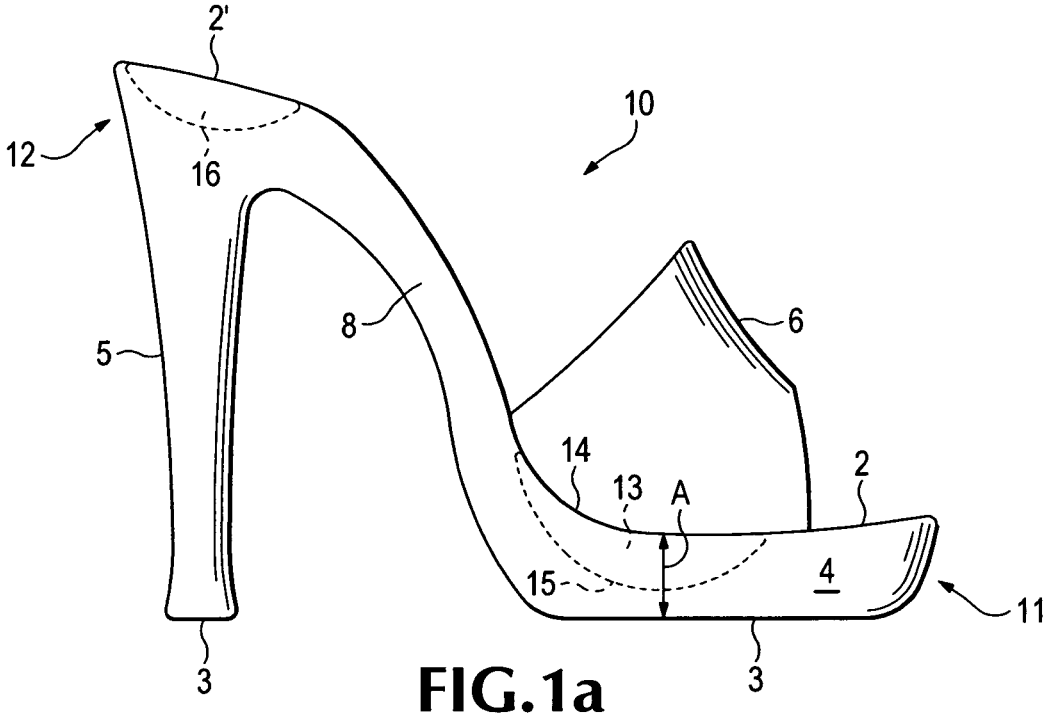
FIG. 1*a* depicts in sectional side elevation view a substantially-inclined shoe configured according to an embodiment of the invention.

Aesthetically-oriented shoes, typically but not exclusively women's fashion, business, and casual shoes, generally comprise an anterior (toe) portion and a posterior (heel) portion which is elevated relative to the anterior portion. This configuration inclines the foot along an anterior-posterior axis, whether minimally, substantially, or extremely. It is not at all uncommon for the user's heel to be elevated several inches higher than the toes during normal wear, placing and maintaining the foot in a plantarflexed position, which is physiologically unnatural for extended periods of perambulation.

Substantial portions of the soles of such shoes, including the heels, typically comprise a relatively rigid material and/or construction, preventing and/or constraining heel-to-toe flexion while walking. Further, the total ground contact area of the soles of such shoes is typically less than the total surface area of the user's foot. These factors, combined with the inclined foot orientation and height of the heel portion, cause a substantial decrease in the stability of a user's leg, foot, and particularly, ankle, during use. Thus, such shoes are generally unsuited for applications involving quick and/or aggressive lateral movements, or which require substantial toe-to-heel flexion, such as athletics and/or active physical labor.

Additionally, the plantarflexed condition of the foot during use of substantially-inclined fashion shoes concentrates stress at the ball of the user's foot. Although the foot includes some natural padding underlying its rather boney structure when held in a plantigrade position, plantarflexing of the foot causes portions of the boney structure to project more notably, reducing the effectiveness of the natural padding.

Unlike athletic activities, which generally tend to be limited in duration, a user may typically wear a substantially-inclined shoe for eight to ten (8-10) hours or more during an average work day, and may wear the same or a different substantially-inclined shoe for several hours more after work, such as for social activities. Thus, during the course of a day, the accumulated and concentrated stresses can cause substantial foot fatigue at the least, and injury at the worst. Over the course of weeks, months, and even years, such stresses, if left unmitigated, can result in chronic, lasting damage to a user's foot.

The invention, with its numerous conceived embodiments, provides solutions to the above problems, which are not contemplated or resolved, expressly, impliedly, or inherently, by the prior art. For example, the Swigart patents seek to address the types of forces and stresses inherent in athletic activities. Athletic shoes are typically designed for aggressive heel strikes, relatively high lateral and sheer forces, repeated and substantial heel-to-toe flexion, and to provide an energy return means (e.g., bounce, rebound, etc.) between the foot and the ground. Athletic shoes are generally provided with soles having a ground contact surface equal to or greater than that of the user's foot, providing enhanced stability. Light weight is also a key goal in athletic shoes. Placing a flexible chamber of air or another compressible gas within the thickness of a relatively flat inner and/or outer sole of a shoe, typically comprising an elastic polymer material surrounding the chamber, meets these purposes.

However, the Swigart patents specifically, and the prior art generally, do not describe or contemplate usage conditions addressed by the instant invention, nor would the Swigart patents provide a suitable solution if applied to the shoes and applications described herein. Those having skill in the art will recognize that the Swigart patents and the instant invention each derive from entirely different objectives, disparate shoe materials and construction, and usage conditions distinct from one another. Such differences will become more apparent in light of the description, drawing figures, and claims provided herein.

Throughout this description, the terms 'may', 'can', 'should', and others are used (e.g., 'may be', 'may include', 'may comprise', etc.) to indicate that while details of an element are present in one embodiment, other embodiments may differ in the details of one or more elements. Therefore, these terms are used herein in a definite sense relative to at least one embodiment, but not all embodiments, and will not be considered indefinite by one having skill in the art.

Likewise, various terms indicating a position (e.g., above, below, top, bottom, lateral, beside, etc.) are used herein. Generally, but not exclusively, these terms relate to a shoe placed in an upright position upon a planar, horizontal substrate (as when being normally stood upon by a user). However, because shoes can also be turned in other orientations during use, such positional terms should not be interpreted in an overly limiting fashion, nor are they so intended.

Occasionally, ordinary terms in the art fail to properly describe aspects of the embodiments, or present the possibility of improper interpretation of applicant's conceived embodiments. Therefore, special definitions may appear throughout this description. Where terms used herein are subject to multiple meanings, or are used in other than an ordinary manner, whether the term itself is novel or ordinary, they are to be interpreted first according to special definitions provided by the description, drawings, and/or claims herein. If no special definition for a particular term is provided herein, only those ordinary meanings which comport firstly with the explicit description, drawing figures, claims, and/or secondarily with what one having ordinary skill in the art would understand from the same, shall be considered proper.

Turning now to the drawing figures, FIG. 1A depicts a sectional elevation view of a shoe 10 recognized as having an anterior portion 11 proximate a user's toes when worn by a user (as would be recognized in the art), and a posterior portion 12 proximate a user's heel. A boundary between the anterior and posterior portions is generally conceptual rather than actual, and may relate to the unique structure of a particular shoe type, or may be assigned solely for descriptive clarity and/or convenience. Occasionally, a middle portion 8 may be described as interposed therebetween, whose boundaries relative to the anterior and posterior portions are likewise generally conceptual in nature, but may also be structurally defined. For illustrative and reference purposes only, the terms 'anterior portion', 'middle portion', and 'posterior portion' can be applied to relatively equal longitudinal thirds (⅓) of the overall length of a shoe from the anterior to the posterior thereof, respectively.

The shoe further comprises a first generally upwardly presented foot-engaging surface 2/2', and a generally downwardly presented ground-engaging surface 3. Interposed therebetween is a rigid foot-supporting portion (hereinafter, base) 4 comprising at least a first thickness 'A' of a relatively rigid supporting material. For clarity, the entire rigid base 4/304, as depicted in FIGS. 1*a* and 3*a*-3*c*, is a portion of the shoe's sole (referred to as a 'rigid sole portion' in the claims), whether such rigid sole portion a midsole, an outsold, or a midsole and outsole combined to form a unitary and rigid structure. The base 4 is generally, but not exclusively, contiguous from the anterior portion 11 to the posterior portion 12. As used herein, 'relatively rigid', or simply 'rigid', means not only that the material does not generally compress, flex, or otherwise deform significantly in response to forces applied during normal use, but also that the general shape and volume of a recess formed into the material of the base is generally retained during perambulation and other similar activities.

Alternatively, the material may be relatively more flexible in a thinner configuration, but the thickness of the material utilized in embodiments renders it relatively inflexible (e.g., rigid). Examples of such (relatively) rigid materials include dense polymer materials (e.g., Lucite plastic, acrylic, thermoplastic resin, etc.), wood, built-up laminated leather, impregnated cardboard, fiberboard, hard vulcanized rubber, dense composites and/or natural materials (e.g., dense cork, etc.), and others as are known in the art.

The thickness of the base 4 at any point between the extreme anterior and posterior portions can vary widely relative to the first thickness, and can also vary as measured at different points across the width of the shoe 10. In general, however, the embodiments described herein are most advantageously demonstrated in a base having a first thickness that is greater than or equal to one-quarter of an inch or (≧¼"), at or proximate the anterior portion.

In a particular embodiment, a first thickness of the base 4 at or near the anterior portion is generally greater than one inch (1"), and may be more typically found within a range of two to six inches (2-6"), such as in substantially-inclined shoes typically used for 'exotic dancing' (e.g., so called 'stripper shoes') and similar activities. In a large number of embodiments, the first thickness is consistently less than one inch (1"), such as might be used in more typical office settings, social events, and other regularly engaged activities. These ranges are illustrative in nature, however, and do not limit the numerous alternative embodiments contemplated within the scope of the invention.

As mentioned, when engaged with a user's foot during normal use, a substantially-inclined shoe places a user's foot in a condition of plantarflexion. As depicted by FIG. 1A, a substantially-inclined shoe 10 typically possesses a heel 5 configured to elevate a posterior foot-engaging surface portion (heel rest) 2' relative to an anterior foot-engaging surface portion (forefoot rest) 2. For an average-sized woman's shoe, relative to the ground-engaging surface 3, a difference in elevation of the heel rest 2' as compared to the forefoot rest 2 is approximately two inches (2") or more. When such elevation difference is present in an embodiment, the shoe is referred to herein as being 'substantially inclined'.

However, in the case of a child or an adult having a relatively shorter foot than average (e.g., size 8-8.5 for women), an elevation of less than two inches may also be considered 'substantially-inclined'. For example, an average women's shoe size in the United States is size eight (8), which correlates to a foot length of approximately nine and seven-tenths inches (9.7"). Assuming that approximately seven inches (7") of this length lies between the ball of the foot and the posterior of the heel, and the heel is elevated approximately two inches (2") above the heel, an inclination angle of approximately sixteen and six-tenths degrees (16.6°) is obtained.

For the purposes of this description and the embodiment, therefore, an inclination angle of approximately fifteen degrees (15°) or more at any part of the posterior and/or middle portion of the foot-engaging surface along an approximately anterior-posterior axis of a shoe is considered 'substantially inclined'. An 'approximately anterior-posterior axis' is any axis which passes through both the posterior portion and the anterior portion of the foot-supporting surface, through both the posterior and middle portions thereof, and/or through both the middle portion and the anterior portion of the foot supporting surface. By 'approximately' fifteen degrees, it is meant that an inclination angle in which the tenths of a degree would normally be rounded upward to fifteen degrees (e.g., 14.5°) would likewise be considered 'substantially inclined'. Thus, a difference in elevation of the heel rest 2' as compared to the forefoot rest 2 of less than two inches (2") can constitute a 'substantially-inclined' shoe in a relatively shorter than average shoe, when such elevation inclines the posterior and/or middle portions of the foot-engaging surfaces of a shoe at an angle of approximately fifteen degrees (15°) or greater.

Although FIG. 1A depicts a significant length of the heel 5, extending from the ground engaging surface 3 upward toward the heel rest 2', as relatively separate structurally from the anterior portion 11 of the base 4, the embodiments are not so limited. For example, alternative embodiments include shoes in which the posterior portion 12 and anterior portion 11 of the base 4 are relatively contiguous throughout, forming what is commonly referred to as a 'wedge'. In a wedge-type shoe, the heel 5 is not significantly and/or structurally distinct, but is recognized by its posterior position relative to the shoe 10.

Conversely, alternative embodiments include even more structurally distinct heels. One example includes a relatively long and greatly narrowed heel commonly referred to as a 'stiletto' heel. Frequently, shoe types are distinguished and referred to by one or more aspects of the structural configuration (e.g., appearance, etc.) of the heel 5 specifically, or the base 4 generally. Various examples according to alternative embodiments include aforementioned 'stilettos' and 'wedges', as well as 'mid-heels' (e.g., having heel lengths between approximately 2½ inches and 3½ inches), 'high-heels' (e.g., having heel lengths greater than approximately 3½ inches), and others.

Other types of substantially-inclined shoes included within alternative embodiments of the invention include boots, sandals, pumps, sling-backs, and platforms, although this list is exemplary only. While the term 'high-heeled shoe' generally refers to the length of the heel 5, the term 'substantially-inclined shoe' is used herein to refer to any shoe with an elevation difference of two inches (2") or more at the heel rest 2' relative to the forefoot rest 2, without regard for the specific length of the heel. The embodiments encompass an exhaustive scope of substantially-inclined shoes, however commonly identified in whatever language used, and in any commercial, industrial, fashion, casual, or other setting.

The substantially inclined orientation of shoes according to the embodiments presents a need to secure the shoe to the user's foot, and retain the foot in a proper position relative to corresponding structures of the shoe, as one having skill in the art would recognize, thus preventing a shoe from inadvertently disengaging from or shifting relative to a user's foot during wear. While numerous substantially-inclined shoe styles include fully and/or partially foot-enclosing uppers (e.g., boots, etc.) for these purposes, not all shoes include such generously proportioned 'uppers'. For example, as shown in FIG. 1*a*, a substantially-inclined shoe may include only one or more straps (uppers) 6 provided proximate to the anterior portion 11, and configured to provide aesthetic and comfort benefits to the user.

Alternatively, the uppers 6 can be more or less generously proportioned (e.g., narrow bands, wide bands, strings and/or straps extending around a user's heel and/or encircling a user's ankle), etc. The uppers 6 depicted in FIG. 1*a* are intended to represent an exemplary embodiment. However, a great variety of foot-retaining structures (e.g., whether fully or only partially foot-enclosing, including also boots of all heights characterized by ankle and/or leg-covering uppers) currently utilized or reasonably contemplated for use with substantially-inclined shoes, are considered within the scope of the invention. Broadly stated, any structure extending above a foot-engaging surface of a shoe, and configured at least in part to engage a portion of a user's toe, foot, and/or leg and couple the shoe therewith, is considered an upper according to an embodiment herein.

The configuration of each of, and structural relationship between, the upper 6 and the rigid base 4, generally defines a limited space into which the foot is inserted and retained. However configured, uppers 6 generally provide aesthetic and/or comfort-enhancing benefits. In a significant number of embodiments, however, uppers 6 are designed primarily for aesthetic purposes, and in use, actually contribute to the user's discomfort. Contributing factors include a poor shape and/or size correspondence with the user's foot (e.g., too tight, too loose, foot-pinching shape, insufficient toe-space, etc.), insufficiently flexible materials used in the upper, and the relative rigidity of the base 4. The substantially inclined configuration of the shoe tends to urge the user's foot down the incline of the shoe toward the anterior portion 11, likewise urging the foot into forcible confrontation with one or more portions of the upper 6. Such forcible confrontation adds to the user's discomfort.

Therefore, embodiments of the invention include one or more recesses formed to a suitable depth into the foot-engaging surface(s) 2/2' of the shoe 10. FIG. 1*a* depicts an exemplary recess 13 formed into the forefoot rest 2 and extending through a portion of a first thickness 'A' of the base 4. Generally, a suitable depth of a recess 13 will extend through approximately five to ninety-five percent (5-95%) of the first thickness 'A' (plus or minus three percent (3%)), but may extend through less or more of the first thickness in one or more embodiments. A recess formed to a suitable depth will generally not, however, extend though the ground-engaging surface of the shoe, nor will a suitable depth generally be formed so shallowly as to receive less than approximately one-third (⅓) of the volume of a fluid-filled bladder disposed therein. Thus, as shown by the examples depicted in FIGS. 3*a*-3*c* and described above, the recess is formed into but does not extend beyond the rigid structure of the base (rigid sole portion) 4/304, without regard to whether, as described above, the base is formed of a single rigid (e.g., incompressible, inflexible, non-deforming, etc.) material layer, or is instead formed of plural material layers joined together to form a rigid, unitary structure.

A recess 13 generally includes one or more interior surfaces 15, an opening 14 presented at the foot-engaging surface(s) 2/2', and an interior volume generally defined by dimensional aspects of the recess (e.g., depth, width, circumference, etc.). The interior of the recess 13 can be nearly any configuration, whether symmetrical or asymmetrical. The inner surfaces can be tapered, convex, concave, relatively planar, or any combination thereof. Where adjacent interior surfaces form an angular junction, such angles can be obtuse, acute, or normal, and can include a radial curvature according to alternative embodiments.

The perimeter shape of the recess opening 14 can likewise be symmetrical or asymmetrical, and can be nearly any shape. An angle formed at a junction between the foot-engaging surface(s) 2/2' and an inner surface 15 of the recess 13 can be obtuse, acute, or normal, or the junction can be rounded, beveled, stepped, or otherwise configured according to alternative embodiments.

As depicted in FIG. 1*a*, a substantially-inclined shoe can include one or more additional recesses 16 formed into the foot-engaging surface(s) 2/2', and each additional recess may be configured either the same as, or differently from, a first recess 13 in at least one dimension and/or other aspect thereof. Although FIG. 1*a* clearly depicts at least two recesses 13/16, it should be recognized that additional recesses could exist in the embodiment of FIG. 1*a* that are not viewable in the plane of the depicted section.

Figure 1B:
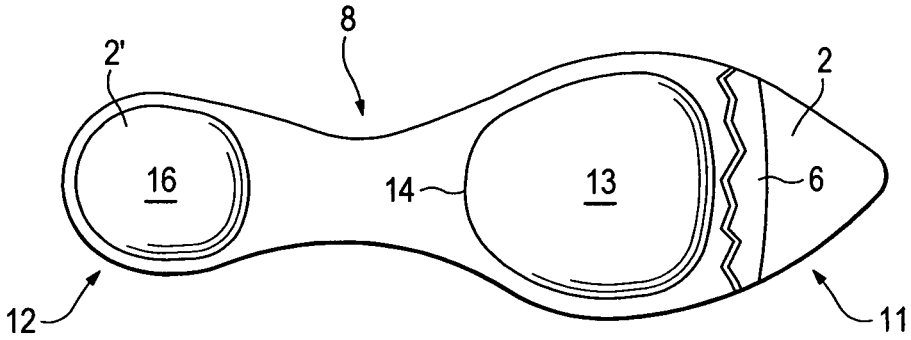
FIG. 1*b* depicts in plan view a foot-engaging surface of a substantially-inclined shoe according to the embodiment depicted in FIG. 1*a*, with portions of an upper removed from view, according to an embodiment of the invention.

FIG. 1*b* substantially depicts, in plan view, a foot-engaging surface of the shoe of FIG. 1*a*, according to one embodiment, with portions of the upper 6 removed from view. Recess 13 is shown disposed proximate the anterior portion 11 (and anteriorly relative to middle portion 8) and having an approximately ovoid opening 14 formed into the forefoot rest 2. Recess 16 is shown disposed proximate the posterior portion 12 of the shoe, and having an approximately circular opening formed into the heel rest 2'. As discussed above, the perimeter shapes of the openings of either or both recesses 13/16 could be different from those depicted, according to alternative embodiments.

Recesses 13/16 for formed and configured according to the individualized structural constraints of a particular shoe style. Constraints can include the thickness of the base 4 at any or all of the anterior portion 11, middle portion 8, and/or the posterior portion 12, overall length of the shoe 10, the width of the foot-engaging surface 2/2' and underlying base 4, the positional relationship of a user's foot to the foot-engaging surface 2/2', and other factors. In general, however, a recess 13/16 will be formed to a sufficient depth into the base 4 to maintain a continuous separation between a designated portion of a user's foot and an inner surface of the recess 13/16 when a suitably configured force-responsive, fluid-filled bladder is disposed therebetween.

Figure 2A:
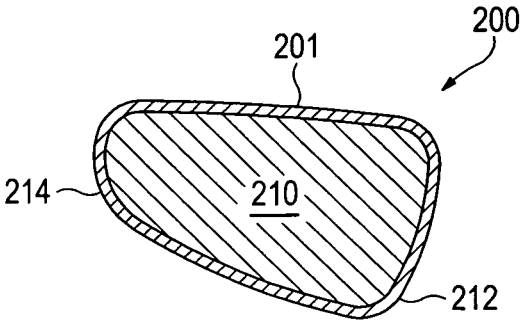
FIGS. 2*a*-2*b* depict in sectional side elevation view viscous-fluid-filled bladders according to alternative embodiments of the invention.

As represented by the embodiment depicted in sectional side elevation view in FIG. 2*a*, a force-responsive, fluid-filled bladder 200 is generally formed of a leak-resistant, flexible bladder 201 containing a relatively viscous filler material 210. A bladder 201 can be configured according to various sizes and or shapes, but is generally configured, when filled with filler material 210, to fit mainly within and conform dimensionally relative to an inner configuration of a recess 13/16. As used herein, a 'fluid' is a flowable, non-gaseous substance (e.g., 'filler material') having a kinematic viscosity found within the range(s) described below.

In an exemplary embodiment, bladder 201 is formed of a soft polyvinyl chloride material including suitable plasticizer ingredients (as are known in the art) to render the bladder flexible and resilient. Of course, other materials may be used, and are contemplated in one or more embodiments, provided they exhibit structural and functional characteristics conforming to those described herein. For example, silicone, polyurethane, and neoprene constitute non-exclusive examples of suitable alternative bladder materials for use with a wide variety of filler materials. In general, any leak-resistant, flexible material capable of retaining the described filler material under conditions described herein is a suitable bladder material. Additionally, a bladder can be formed with two or more layers, comprising either similar or disparate materials, whether bonded together or separate with one layer fully or partially encompassing one or more other layers.

Alternatively, a bladder may be formed in an embodiment from a fluorocarbon-based membrane, for example, expanded polytetrafluoroethylene (ePTFE), more commonly recognized as the operative material in the waterproof membrane GORETEX. Although generally considered waterproof, ePTFE tends to stretch in response to a sufficient applied force, and is generally relatively thin. Therefore, in such embodiments, an inner fluorocarbon-based membrane may be bonded (e.g., laminated) with an outer, higher tensile-strength material (relative to ePTFE), such as nylon, polyester, or a similarly rupture-resistant (e.g., tear-resistant, abrasion-resistant, etc.) textile, from which the bladder is constructed using leak-resistant sealing means and/or methods, as are known in the art. Likewise, the rupture-resistant textile may be configured as a pouch which surrounds (e.g., either entirely separately, or mostly separately with some interconnections formed therebetween) the leak-resistant bladder layer, such as a fluorocarbon-based membrane. Together, the pouch and the leak-resistant bladder form a 'bag-within-a-bag' dual-layer bladder, wherein the filler material is disposed within the fluorocarbon-based membrane bladder.

A rupture-resistant outer bladder material can likewise be used (e.g., according to the laminated and/or bag-within-a-bag configurations described above) with alternative leak-resistant bladder materials (e.g., PVC, silicone, neoprene, polyurethane, or other flexible materials), enabling the walls of such inner bladders to be substantially thinner than if used alone. Alternatively, a rupture-resistant textile can be infused with (e.g., saturated with and/or embedded within) a leak-resistant material (e.g., liquid rubber, silicone, etc.), to form a rupture-resistant and leak-resistant unitary bladder material, or as mentioned above, can be bonded with a leak-resistant material. Of course, an embodiment is also contemplated in which neither the textile nor the leak-resisting material are independently 'rupture-resistant', but when combined in one of the methods described above, the resulting composite material is rupture-resistant.

Generally, a suitable bladder material will resist degradation (e.g., hardening, dissolution, weakening, corrosion, etc.) when exposed to one or more of a wide variety of substances, including water, salts, oils, surfactants, environmental pollutants, mild solvents, etc., that might be encountered during normal use, storage, cleaning, or other reasonably expected activities. Likewise, a suitable material will typically resist degradation in response to most ordinarily-observed weather conditions (e.g., temperature, humidity, etc.), and to sunlight (direct or indirect), fluorescent lighting, or other reasonably expected forms of ambient radiation.

Generally, a bladder 201 wall thickness and material formulation must be sufficiently robust to resist rupture when subjected to both the static and dynamic forces presented by a user's foot during reasonably expected activities. Such forces can be anticipated according to an embodiment by calculating the area of a user's foot through which such forces may be translated (the 'force application area'), assuming a users weight within a reasonable range (the 'load range'), and dividing the latter by the former to arrive at an applied load per unit area, or 'pressure'.

For example, a user having a relatively small foot might have a force application area, corresponding to the 'ball' of her foot, that measures approximately three inches (3") wide, side to side, by one and one-half (1½") long, front to back. This situation presents a force application area constituting approximately four and one-half square inches (4½" sq.) at the ball of each foot. Further, considering the relatively small size of the foot, a reasonable range of weight estimates for the user might extend from approximately seventy-five pounds up to approximately two hundred and fifty pounds (75-250 lbs.). Dividing the user's weight by the force application area yields a potential static load range of approximately sixteen and one-half to approximately fifty-five and one-half pounds per square inch (16.5-55.5 p.s.i.). Applied static loads and/or pressures can be higher, however, such as for notably heavy persons, or lower, such as for children or notably thin persons.

A range of applied dynamic forces, however, may be higher that for static loads, as force-increasing acceleration occurs when a user walks, descends stairs, or undertakes other similar activities. Although not generally contemplated, excess pressures can occur in the rare even that a wearer of substantially-inclined shoes must run or jump (e.g., such as to catch a bus, or is surprised by a sudden noise, etc.). Accordingly, the bladder is designed, in embodiments, to withstand irregular, improbable, and unusual dynamic forces.

Assuming that dynamic forces may be greater than twice the corresponding static loads, we can reasonably determine that the bladder 201 of a fluid-filled bladder 200 in an embodiment should withstand an applied force up to approximately one hundred and twenty pounds per square inch (120 p.s.i.) without rupturing or collapsing. Alternative embodiments can likewise be configured to withstand much higher applied forces (e.g., exceeding 120 p.s.i., up to and including several multiples thereof), while remaining within the scope of the contemplated invention. Examples of elevated rupture resistance thresholds include 200 p.s.i., 300 p.s.i., 400 p.s.i., or higher, and can include any increment or range found therebetween or extending therethrough.

Of course, one having ordinary skill in the art will recognize from this description that a rupture threshold of a bladder 200 wall (e.g., an applied force at which the structural integrity of a bladder wall fails) can be increased by increasing the thickness of the bladder wall, or by including a rupture-resistant material, as may be needed to withstand higher applied forces incurred during some activities. Likewise, the overall rupture resistance of the bladder is limited at least in part to that of the thinnest portion of the bladder wall. Thus, although a thickness of a bladder wall can be non-uniform in an embodiment, a minimum thickness at any part thereof will exceed that needed to withstand the applied forces expected to be applied by a user during reasonably expected use conditions.

In use, a fluid-filled bladder will mainly be disposed within and retained (captured) by a recess formed within a rigid base 4, which will resist expansion or deformation of portions of the bladder in contact therewith. Likewise, relatively more solid portions of a user's foot itself will resist excessive deformation (e.g., deformation sufficient to cause rupture or other permanent damage) of a fluid-filled bladder in those directions not generally surrounded by a rigid base 4. Therefore, one skilled in the art will recognize that a bladder according to the described embodiments of a substantially-inclined shoe need not be overly thick, and therefore can retain substantial flexibility.

As the weights of various users increase, so too generally do the sizes of their feet, and thus the size of the load application area. Therefore, while both the static load ranges and dynamic force ranges may increase somewhat in the case of larger users, this increase can be accommodated within the scope of the invention. It is not contemplated herein that morbidly obese users above a reasonably expected weight would choose to wear substantially-inclined shoes, due to concerns for stability. However, an embodiment of the invention contemplates even highly obese and/or otherwise heavy users.

Figure 2B:
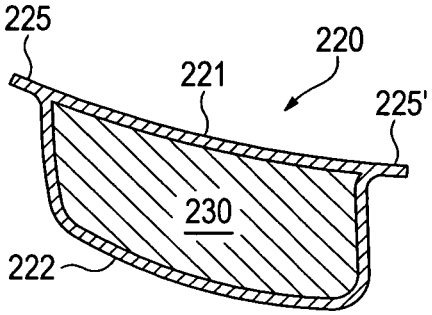

To aid in rupture resistance, a bladder 201 may typically be formed as a single, generally seamless unit, as depicted in FIG. 2*a*. Alternatively, a bladder 221 may be formed of two or more separate components joined together by welding, crimping, gluing, or some other method as known in the art, as shown in FIG. 2*b*. According to some embodiments, seams 225/225' may exist at one or more portions of the bladder. Provided the seams 225/225' are demonstrated to resist rupture at or above the anticipated range of applied force, seamed bladders 221 constitute an acceptable embodiment. However the bladder is formed, a suitably viscous filler material 210/230 is disposed therein, with all or substantially all undissolved gases (e.g., air, etc.) excluded, and the bladder 201/221 is then sealed.

Filler materials may be any one of, or any suitable combination of, a liquid, a flowable polymeric material, a viscoelastic fluid, or another flowable material which exhibits viscosity properties similar to those described herein. For example, polydimethylsiloxane is an exemplary material which possesses such beneficial properties. Additionally, a suitable material will also maintain its viscosity within a suitable range even when exposed to temperatures within a reasonably expected use range (for example, −10° to 50° centigrade). Of course, some filler materials may operate favorably throughout different and/or more extreme temperature ranges than others, and are likewise considered suitable in one or more embodiments.

The materials of each of the bladder 201 and the filler material 210 should generally be compatible with one another, such that contact of one with the other for extended periods of time does not notably degrade the material and/or performance characteristics of either. Likewise, a suitable filler material will generally resist degradation in response to similar substances and/or forms of ambient radiation as those discussed above relating to a suitable bladder material. Ideally, a suitable material will also possess properties providing environmental benefits (e.g., reclaimable, reusable, recyclable, non-toxicity, inertness, no hormone-mimicking action in organisms, etc.).

Inasmuch as undissolved gases are generally excluded, an amount of viscous filler material 210/230 disposed within a bladder 201/221 is generally volumetrically-defined by the bladder. However, sufficient filler material 210/230 is typically provided within a bladder 201/221 to achieve and maintain a suitable tension at the surface of the bladder. A level of tension that is 'suitable' depends on many factors, and may, for example, correspond to an intended level of resistance to deformation in response to an applied load. Generally, in the absence of an applied load, a suitable tension will exist when the filler material 210/230 applies an outward pressure at all portions of the bladder 201/221 (e.g., there is little or no 'slack' in the bladder). Alternatively, a suitable outward pressure is one which causes a portion of the bladder to extend (e.g., bulge) above the foot-engaging surface, and/or is sufficient to prevent collapse (e.g., 'bottoming out') of the fluid-filled bladder in response to a load applied by a user's foot, when disposed within a correspondingly configured recess. Therefore, a user's foot, when first disposed within the shoe, will encounter and nominally deform the upwardly extended fluid-filled bladder prior to encountering and resting upon the surrounding the foot-engaging surface.

Referring to FIG. 2*a* for simplicity, with regard to the viscous filler material 210, numerous options are available according to alternative embodiments. Generally speaking, a suitable viscous material is one having a kinematic viscosity found within a range of approximately ten thousand to sixty thousand centistokes (10,000-60,000 cSt.). A material having a viscosity within this range will possess flow characteristics similar to honey at one extreme, and thick molasses at the other, although these comparisons are provided for illustrative rather than limiting purposes. Within this kinematic viscosity range, numerous narrower preferred ranges may also be identified for use in embodiments designed for specific users, configurations, shoe types, therapeutic purposes, or other applications. Likewise, suitable viscosity ranges may extend partially, and/or exist entirely, outside this range, with each range still being contemplated within the embodiments of the invention.

For example, in an alternative embodiment, a suitable filler material may possess a kinematic viscosity found within a broader range including that of water (approximately 1-5 cSt.) at one end of the range, and that of hot tar (approximately 100,000 cSt.) at the other end of the range. Such a broad range can encompass and provide a variety of beneficial uses according to specific functional objectives, the anatomical/physiological conditions of a specific user (e.g., a child as opposed to an obese adult), and/or other considerations too varied to list here.

For example, a more viscous material can provide a relatively delayed and/or slower deformation response to an applied force, or provide a similar response for a heavier person that a less viscous filler material would provide for a less heavy person. Therefore, while additional exemplary ranges are not provided in detail herein, such ranges can be determined based on this description relative to anticipated forces in an embodiment. Likewise, a viscosity of a filler material in an embodiment may also be selected based upon an individual's idiosyncratic anatomical features or subjective preferences.

A preferred embodiment includes a filler material 210 that is relatively non-compressible. For example, an exemplary silicon fluid (e.g., available from Clearco Products) having a viscosity of approximately twelve thousand five hundred centistokes (12,500 cSt.) is less than four and one half percent (4.5%) compressible at approximately seven thousand (7,000) p.s.i. of applied pressure. Thus, at the comparatively lower loads anticipated within the range of the typical embodiments (discussed above), the silicon fluid filler material may be considered relatively (although not absolutely) non-compressible. Similar materials having alternate viscosities, or filler materials other than silicon fluid, may be more or less compressible than this exemplary embodiment. In most cases the contemplated embodiments may likewise be considered relatively non-compressible within the typically anticipated range of applied forces.

In order to provide the intended responsive cumulative-force reduction at a user's foot, the fluid-filled bladder 200 should not fully collapse under an applied load falling within a load range for which the bladder is designed. Collapse, or 'bottoming out', is defined herein as the failure of a fluid-filled bladder to maintain a boundary of filler material 210 suspending a designated portion of the user's foot above (or otherwise separating it from) an inner surface of a corresponding recess 13/16. Upon collapse, impact forces may be translated directly through the shoe to the user's foot, rather than being dissipated in a plurality of directions by a viscous, fluid layer interposed between the shoe and a designated portion of the foot. 'Designated portion of the user's foot' herein generally refers to any one or more portions of a user's foot intended to overlie a portion of one or more force-responsive fluid-filled bladders 200 disposed within a recess formed in a shoe, according to an embodiment of the invention.

Designated portions of a user's foot generally, but not exclusively, correspond to one or more of the calcaneus (heel) bone, one or more proximal metatarsal bones, and one or more proximal phalanges. In particular, the plantarflexed condition of a user's foot in a substantially-inclined shoe, concentrates forces applied between a user's foot and a shoe at a location corresponding to a junction between one or more metatarsal bones and each corresponding proximal phalangeal bone ('metatarsal-phalangeal junction'). Therefore, according to an embodiment, a fluid-filled bladder 200, and a corresponding recess 13 provides a greater 'depth' of viscous material aligned in a direction of maximum typical force application relative to a designated portion of the user's foot.

A fluid-filled bladder 200 having a flexible, resilient bladder 201 filled with a relatively high-viscosity and non-compressible filler material 210, provides substantial benefits in the contemplated embodiments. In response to a force applied by a designated portion of a user's foot, the bladder 201 will tend to deflect (e.g., deform) inwardly away from the applied force. A filler material 210 will likewise tend to move away from the direction of applied force. However, because the filler material 210 is relatively non-compressible, and the rigid base 4 of the shoe prevents deformation of the recess, the only direction the filler material can flow is generally outward and upward toward a portion of the user's foot that exerts a lesser amount of force upon the fluid-filled bladder 200, or which projects downward toward the fluid-filled bladder 200 to a lesser degree than the one or more pressure points.

In operation, this means that the boney portion(s) (e.g., pressure points) of a user's foot will intrude downward into a portion of a deforming fluid-filled bladder, with the filler material retreating from beneath the pressure points at a relatively slow, controlled rate. Meanwhile, other portions of the fluid-filled bladder responsively deform upwardly toward portions of the user's foot surrounding and/or proximate to the boney portion(s). In essence, the deformed fluid-filled bladder cups and cradles those parts of the foot which would otherwise bear a disproportionately high level of stress, and spreads that force out relatively evenly over a broader surface area and structure of the user's foot.

Generally, but not exclusively, an amount of upward deformation of the fluid-filled bladder will approximately equal the amount of downward deformation. As one having skill will appreciate, the response is similar to that of placing an object into a vessel of liquid. The volume of the object residing below the surface of the liquid is approximately equal to the amount of displacement of the liquid.

This foot-conforming response is entirely unlike typical so-called 'gel' insoles (e.g., such as those sold by DR. SCHOLLS, LIFE FITNESS, and others), which lie atop a foot-engaging shoe surface). Typical 'gel' insoles comprise a relatively thin, linearly-compressible pad of soft polymeric material, but which do not employ a flowable and/or migratory, relatively high-viscosity filler material within a bladder. Typical 'gel' insoles compress linearly in response to an applied load, but do not responsively deform upwardly to support other parts of the user's foot. Thus, they fail to 'spread' forces relatively evenly across a larger contact surface of the user's foot than just the pressure points. Further, as described, such insoles have a highly limited range of compressibility, limited for example by their thickness. Their very modest thickness, in turn, is typically limited by the amount of space in a shoe able to accommodate an insole without excessively crowding the user's foot within the upper.

Likewise, gas-filled chambers disposed in a shoe sole (e.g., as in the Swigart patents), tend to deform inwardly in response to an applied load. However, the compressibility of the gases, combined with the relatively high elasticity of materials typically surrounding such chambers, result in no significant upward deformation conforming to relatively-recessed features of the user's foot. Rather, the applied force is compressively distributed evenly throughout the gas-filled chamber, compressing the surrounding materials of the shoe sole.

It should be noted here that the volume of a gas-filled chamber shrinks when the gases therein are compressed by an applied force. Rather than migrating within the gas-filled chamber, well-known physical laws governing the response of compressible gases in an enclosed chamber dictate that the gases compress relatively uniformly throughout. Thus, outward pressure is applied evenly against all walls of the chamber simultaneously, compressing the surrounding material in all directions. Subsequently, the gas-filled chambers and the surrounding materials resiliently rebound, returning the stored compressive energy back to the pressure points of the foot. Not only is this energy return system inherent to the gas-filled chamber art, it is a primary purpose sought and attained by that system.

This response mechanism is advantageous for an athletic performance-supporting shoe, and is a major selling point of NIKE and ADIDAS athletic shoes, to name the two largest examples. However, it does not provide the desired anti-fatiguing and foot-structure protecting benefits of embodiments of the current invention, due both to its exclusive application to athletic shoes designed for plantigrade foot orientation, and that its inherent dependence on compressible, elastically-resilient shoe sole materials precludes its use in rigid-soled shoes. Further, the pressure points of the user's foot remain the primary force-applying portions thereof, with the force-per-unit-area applied by and against the pressure points of the foot remaining quite high.

In stark contrast, the total volume of a fluid-filled bladder 200 in embodiments of the invention remains the same during application of even excessive forces. Further, the filler material responsively migrates, or flows, within the fluid-filled bladder. Because the rigid inner surfaces of the recess do not responsively deform outwardly from the fluid sac, the forces distributed through the filler material cause the fluid sac to extend primarily upwardly toward and conform to the contour(s) of the user's foot. Because the force applied upwardly and conformably to portions of the user's foot surrounding the pressure points, is approximately equal to the pressure applied downwardly by the pressure points, the contact surface area of the foot is increased, and the force-per-unit-area of the user's foot is decreased.

As depicted in FIG. 2*a*, a fluid-filled bladder 200 may be 'deeper' near an anterior portion 212 of the fluid-filled bladder relative to a posterior portion 214 of the fluid-filled bladder, where the anterior portion 212 is aligned with a direction of force application through a designated portion of the user's foot. This asymmetrical configuration helps prevent collapse of the fluid-filled bladder and reduces accumulation of fatigue, thus protecting the user's foot from injury. However, an asymmetrically deeper configuration is not necessary in all embodiments, as will be discussed shortly. Likewise, a fluid-filled bladder can be 'deeper' at a posterior portion than an anterior portion, and/or 'deeper' in a central or lateral portion relative to a contralateral portion and/or a posterior or anterior portion. Such alternatives can correspond to the configuration of a particular shoe and/or the user's foot, as well as other factors (e.g., therapeutic, enhancing balance, aesthetic, etc.).

Figure 3A:
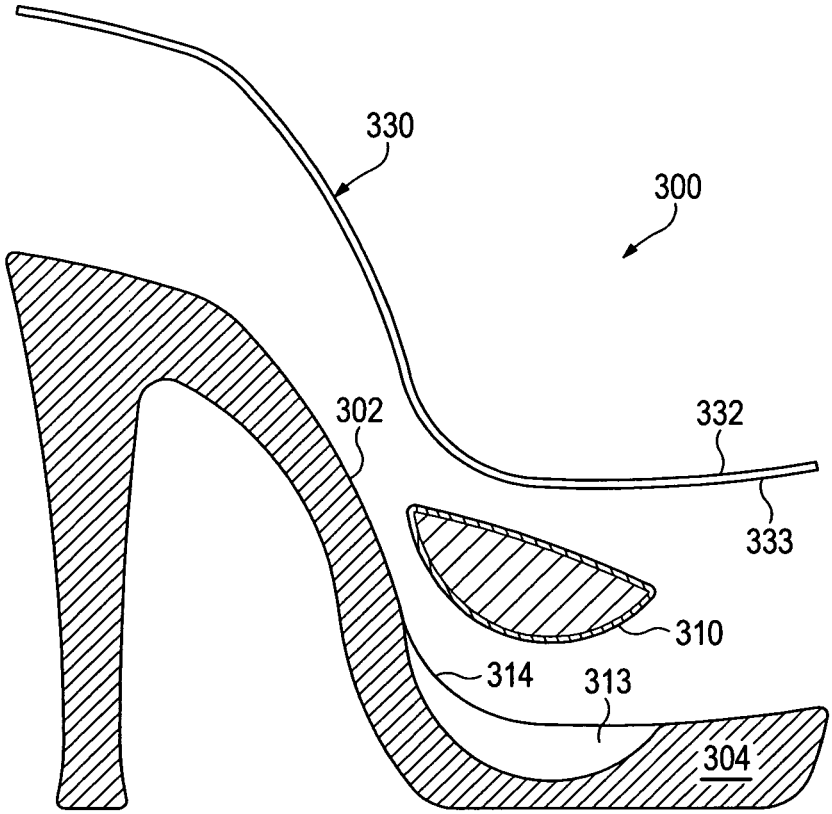
FIG. 3*a* depicts in sectional side elevation exploded view a substantially-inclined shoe configured, with portions of an upper removed from view, according to an embodiment of the invention.

Turning once again to the drawing figures, FIG. 3*a* depicts in sectional side elevation exploded view a substantially-inclined shoe 300 configured according to an embodiment of the invention. A recess 313 is formed into the base 304, and is configured to receive and retain a fluid-filled bladder 310 mainly therein. By 'mainly therein', it is meant that although an upper portion of the fluid-filled bladder 310 will typically bulge above a foot-engaging surface 302 of the shoe 310 in an embodiment, the majority of the fluid sac 310 is contained within the recess and below the foot-engaging surface 302 (like the proverbial 'tip of the iceberg').

Additionally, a flexible lamina 330 formed of a resilient material, having a generally downwardly facing 'bottom' surface 333, and a generally upwardly facing 'top' surface 332, is disposed at and operatively coupled with the foot-engaging surface 302 of the shoe 310. A shape of an outer periphery of the lamina 330 generally, but not exclusively, conforms with, and/or is coextensive with, all or some portion of the outer periphery shape of the foot-engaging surface 302. Therefore, when disposed adjacent to the foot-engaging surface 302, the general shape of the outer periphery of the foot-engaging surface 302, when viewed as in FIG. 1*b*, does not substantially change.

The lamina 330 can vary substantially in thickness as measured at various locations within its periphery, as well as from a lamina 330 used in one type of substantially-inclined shoe versus another. However, in general, a lamina 330 comprises a sufficiently thick and resilient material to compliantly respond to an applied force, such as that presented by a user's foot, and to provide additional cushioning thereto. A lamina according to preferred, but not exclusive, embodiments, is also thin and/or flexible enough to conform to the contours of a user's foot in response to upward deformation of an underlying fluid-filled bladder. A lamina can be rendered as thickly as desired to provide additional cushioning without consuming excessive space within the shoe upper, as such thickness is comprehended as an integral part of the overall shoe design, according to an embodiment. It will be understood that the thickness of lamina 330 in FIG. 3*a* is exaggerated for clarity, although any suitable thickness is contemplated as within the scope of the invention.

Lamina 330 can be formed of any suitable manufacture (e.g., pressed, molded, woven, slurried, or otherwise) and/or suitable material. Examples of suitable lamina materials can include polymeric woven and/or sheet material (e.g., acetate, such as ethylene vinyl acetate (EVA), spandex, neoprene, etc.), suitably prepared natural materials (e.g., leather, hemp, etc.), plush fabrics (e.g., polyester pile, velour, velvet, etc.), or other materials, or any suitable combination thereof. In generally, a lamina 330 provides a comfortable, compliant, foot-contour-conforming, resilient, and/or plush contact surface for all or some portion of a user's foot.

When disposed adjacent to the foot-engaging surface 302, the lamina 330 overlies the opening 314 of the recess 313, as well as the fluid-filled bladder 310 disposed therein. The lamina 330 will generally, although not exclusively, be adhesively coupled at the foot-engaging surface 302 in embodiments, locking the fluid-filled bladder 310 relatively securely into position within and relative to the recess 313. Additionally or alternatively, a lamina 330 may be stitched, nailed, stapled, clamped, or otherwise securely coupled with a shoe, by any suitable method or means or combination thereof, as one skilled in the art will recognize.

In an embodiment, the lamina 330 is adhesively and/or otherwise coupled with the fluid-filled bladder 310 itself, further providing a means for retaining the fluid-filled bladder 310 in position. To allow for deformation without degradation or detachment of the adhesive, an adhesive that forms a flexible, compliant interface when cured is used in an embodiment, allowing some movement of adhesively joined components relative to one another.

Figure 3B:
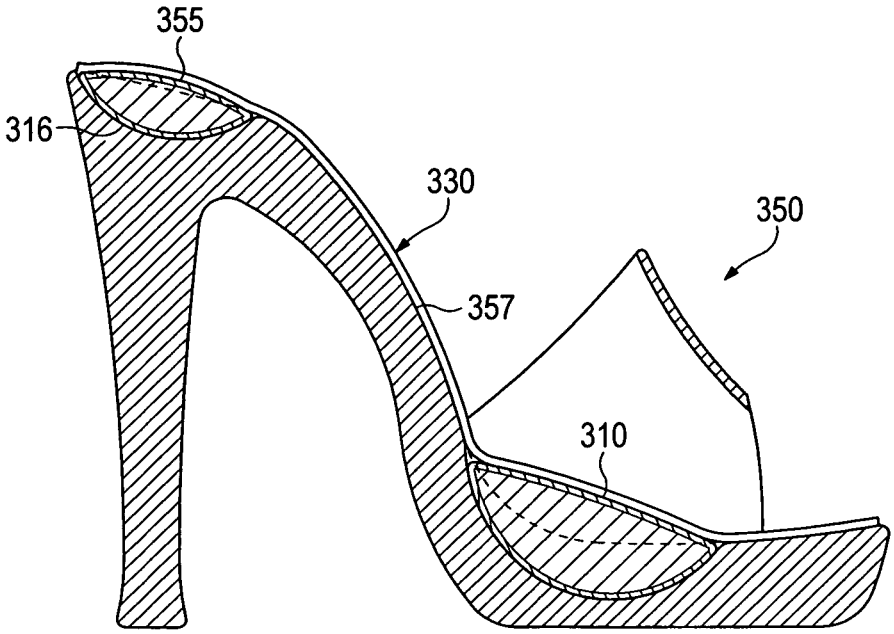
FIG. 3*b* depicts in sectional side elevation view a substantially-inclined shoe, according to an embodiment of the invention.

FIG. 3*b* depicts a sectional side elevation view of an embodiment of a substantially-inclined shoe 300 substantially similar to that of FIG. 3*a*, except not depicted in exploded view. The shoe 350 further includes an additional fluid-filled bladder 355 disposed in a recess 316 formed into the heel rest. As can be seen, an intimate interface 357 is formed between the downwardly facing 'bottom' surface 333 of the lamina 330 and the foot-engaging surface 302. The interface 357 will include an adhesive material in some embodiments but not others, as discussed above.

As also depicted in the embodiment of FIG. 3*b*, a portion of a fluid-filled bladder 310/355 protruding somewhat above a foot-engaging surface 302*a* may cause a convex bulge in the disposed lamina, visually indicating a location of the underlying fluid-filled bladder. When a downward force is applied to the bulging area (such as by pressing the bulge with a finger), it will respond by slowly yielding downwardly in the area corresponding to the applied force, and by bulging further upwardly in one or more areas surrounding the area of applied force. A similar response is obtained in response to force applied by a portion of a user's foot during use.

Likewise, as a generally downwardly applied force shifts in orientation to become relatively more horizontally applied, the fluid-filled bladder responsively deforms corresponding to the shift in force orientation, maintaining a filler material beneath the user's foot and the force-dispersing benefits thereof. Embedded, molded-in-place gas-filled bladders, 'gel' insoles, and other prior art devices cannot similarly respond to shifting angles of applied force. In large part, a gas-filled bladder molded into a shoe sole is immobile relative to the foot-engaging surface of the shoe, and cannot shift therein. In the event of more horizontally orientated applied forces, a detrimental increase in friction between the foot and the insole or other device generally results.

Likewise, nearly any device configured to rest atop a foot-engaging surface of a shoe risks delaminating therefrom and shifting position within the shoe in response to a laterally-applied force. As is commonly seen when users take off their shoes, an inserted insole frequently 'peels' away from the shoe and partially pulls out of the shoe along with the user's foot. This undesirable result is avoided by the described embodiments.

By contrast, embodiments of a fluid-filled bladder enable constantly adjusting upward and downward deformation relative to the foot-engaging surface, as well as some lateral deformation of those portions of the fluid-filled bladder which extend above the foot-engaging surface. Unlike the prior art devices, which reside either wholly below the foot-engaging surface (e.g., the Swigart patents and others), or wholly above it (e.g., replaceable insoles, orthotics, heel pads, etc.), the embodiments typically, and beneficially, extend both above and below the foot-engaging surface.

Figure 3C:
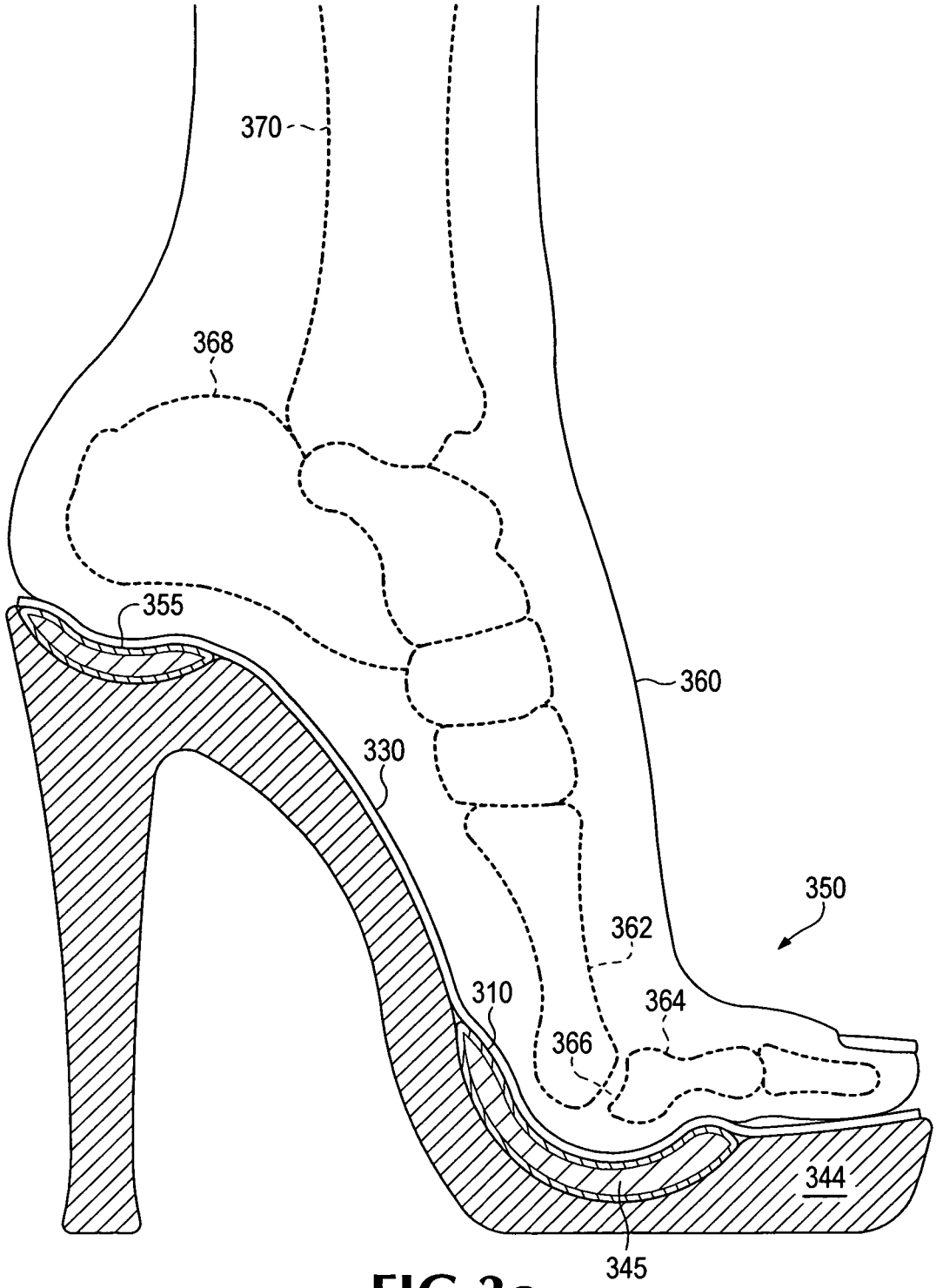
FIG. 3*c* depicts in sectional side elevation view a substantially-inclined shoe according to the embodiment depicted in FIG. 3*b*, including a human foot disposed thereupon, according to an embodiment of the invention.

FIG. 3*c* depicts in cross-sectional elevation view a user's foot 360 disposed relative to the substantially-inclined shoe 350 of FIG. 3*b*, as is typical during use. As can be seen, the foot 360 adopts a plantarflexed configuration in conformity with the configuration of the shoe 350. Due to the resulting plantarflexion, the foot is relatively more longitudinally aligned with the bone(s) 370 of the leg than when positioned in a plantigrade condition. A junction 366 between a metatarsal bone 362 and a proximal phalangeal bone 364 thus becomes a prominently presented terminus for forces applied downward through the user's leg and foot 360. As is also clear from FIG. 3*c*, a fluid-filled bladder 310 is positioned within the shoe 350 at a position corresponding with (e.g., underlying) at least the metatarsal-phalangeal junction 366 (a 'pressure point'), as well as at portions of the metatarsal bone 362 and proximal phalangeal bone 364 proximate to the junction 366. Therefore, the forces translated downwardly through the foot 360 arrive at the compliant, responsive fluid-filled bladder 310 rather than the rigid base 344.

Further, but generally to a lesser extent, gravitational and accelerative forces are also translated down the user's leg bone(s) 370 to the calcaneus bone 368 at the heel of the foot 360. In the depicted embodiment, an additional fluid-filled bladder 355 is positioned within a recess formed into the shoe 350 at a position corresponding with (e.g., underlying) at least a portion of the calcaneus (heel) bone 368.

As shown, the fluid-filled bladder 310 is deformed downwardly corresponding to the pressure point of the foot, but fluid-filled bladder 310 does not collapse. That is, an amount of filler material 345 is maintained beneath the pressure points and other portions of the user's foot, separating them from an inner surface of the recess. Therefore, the user's foot does not 'bottom out' against the rigid base 344. The forces applied by the foot are spread outwardly and then upwardly toward the user's foot by displacement of the filler material 345. Due to the relatively high flexibility of the lamina 330, the fluid-filled bladder 310 is then able to conform substantially to the configuration of the user's foot, providing enhanced support thereto and concurrently increasing the force-bearing surface area of the user's foot.

As discussed above, the conformal response of the fluid-filled bladder 310 is achieved in large part due to the rigid nature of the base 344 of the shoe 350, which prevents the displaced filler material in a fluid-filled bladder 310 from deforming in a direction other than upward toward the user's foot 360. Any application where a fluid-filled bladder is surrounded by a compressible material, for example in an athletic shoe, would not demonstrate the same response, particularly where the fluid is gaseous. Rather, the applied force is directed toward the surrounding compressible material, which then tends to deform (e.g. compress). Compression throughout the material of the shoe is a primary purpose and function driving the selection of non-rigid materials to underlie a user's foot in the vast majority of athletic, industrial, and other insubstantially-inclined shoes. Such prior art structures do not contemplate or accommodate use in a rigid sole of a substantially-inclined shoe.

Further, the absence of structural features coupled with opposing inner surfaces within the fluid-filled bladder 310, in one or more contemplated embodiments, ensures unobstructed omni-directional fluid displacement (e.g., flow, deformation, etc.) throughout the bladder (but not outwardly where constrained by the rigid base material). Likewise, unrestricted upward and downward movement of an upwardly presented surface of the fluid-filled bladder is preserved, allowing conformal response to a full range of foot configurations in response to applied forces from a full range of incident angles. For illustrative purposes only, one can picture an embodiment of the invention exhibiting a response similar to that of a relatively tense rubber hot-water bottle that is filled with honey and being poked by a finger (provided that all but the upwardly presented surface of the bottle is encompassed by and constrained within a rigid material).

Figure 4A:
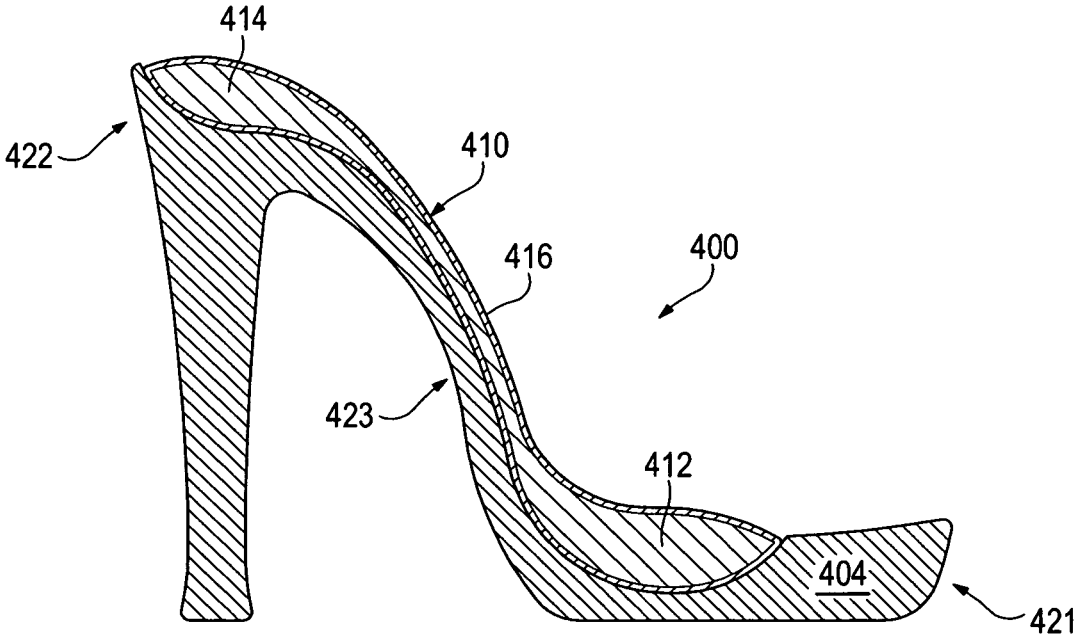
FIG. 4*a* depicts in sectional side elevation view a substantially-inclined shoe, with portions of an upper removed from view, according to an embodiment of the invention.
Figure 4B:
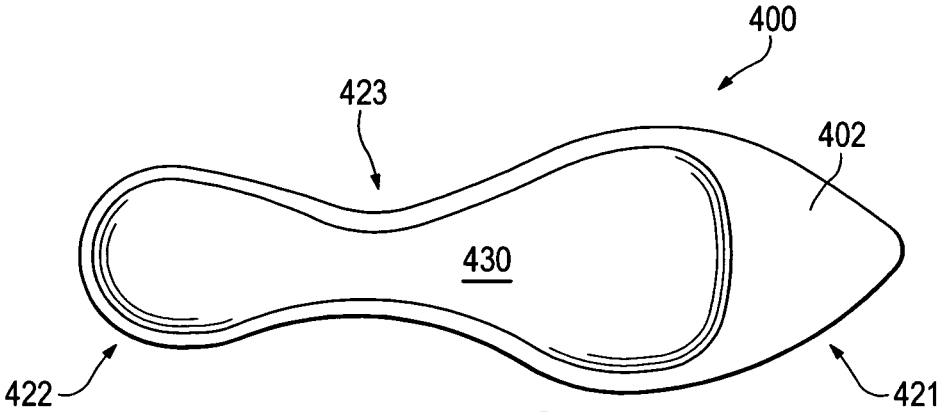
FIG. 4*b* depicts in plan view a substantially-inclined shoe, with portions of an upper removed from view, according to the embodiment depicted in FIG. 4*a*.

Turning now to FIGS. 4*a* and 4*b*, an alternative embodiment of a substantially-inclined shoe is shown. FIG. 4*a* depicts the embodiment in sectional side elevation view, while FIG. 4*b* depicts the same embodiment in plan view. Any uppers, regardless of form, are removed from view to provide an uncluttered depiction of the described features.

As shown in FIG. 4*a*, a substantially-inclined shoe 400 similar to those previously described herein includes a recess 410 formed into the base 404. However, unlike previously described embodiments, the recess 410 extends along a substantial portion (e.g., greater than 50%) of the length of the shoe 400 from proximate the posterior portion 422 to proximate the anterior portion 421. The recess further includes an intermediate recess portion 416 traversing the middle portion 423 of the shoe along an anterior-posterior axis. Each of a posterior recess portion 414 and anterior recess portion 412 are configured to extend relatively deeper into the base 404 than does the intermediate recess portion 416, to provide enhanced protection and comfort to the pressure points of a user's foot. However, such anterior/posterior vs. intermediate depth differentials may be reduced, reversed, and/or eliminated in at least one embodiment.

As with earlier described embodiments, and as shown in the plan view depicted in FIG. 4*b*, a fluid-filled bladder 430 configured to correspond substantially to, and be inserted and retained mainly within the recess 410, will also be included in an embodiment. A filler material disposed within the fluid-filled bladder will generally conform to the descriptions provided above, including all contemplated (e.g. described, suggested, etc.) embodiments thereof. Although FIGS. 4*a* and 4*b* depict a recess and fluid-filled bladder extending only partially toward the anterior portion 421 of the shoe, one having ordinary skill in the art will understand that such depiction is illustrative rather than limiting. Likewise, an embodiment includes a recess and fluid-filled bladder combination which does not extend as far toward the posterior of the shoe 400, and/or approach a lateral edge of the shoe as closely, as in the embodiment depicted in FIGS. 4*a*-4*b*.

Figure 4C:
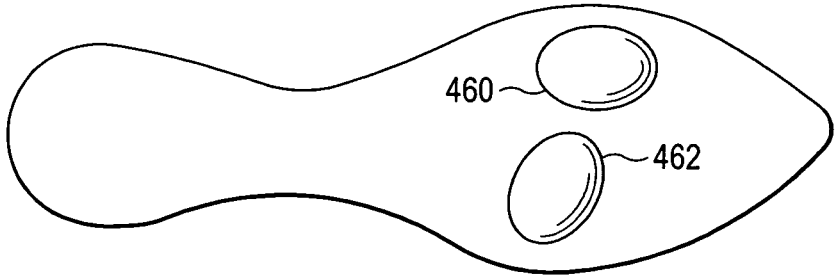
FIG. 4*c* depicts in plan view a substantially-inclined shoe, with portions of an upper removed from view, according to an embodiment of the invention.

As further depicted in FIG. 4*c*, in contrast to the embodiment of FIG. 1*b*, a plurality of recesses and/or fluid-filled bladders 460/462 can be disposed and distributed relatively laterally across a foot-engaging surface 452 of a shoe, rather than, or in addition to, being distributed along an anterior-posterior axis. For example, a first fluid-filled bladder 460 can be disposed to correspond to (e.g., underlie) at least a first metatarsal-phalangeal junction at a more medial portion of the user's foot, and a second fluid-filled bladder 462 can be disposed to correspond to at least a second metatarsal-phalangeal junction located more laterally relative to the first junction. Other arrangements, quantities, shapes, and placements, of two or more laterally adjacent fluid-filled bladders, are also contemplated according to alternative embodiments.

As in the case of any embodiment of the invention having a plurality of fluid-filled bladders, the bladder and/or the filler material of at least one fluid-filled bladder can be different in at least one characteristic (e.g., material type, viscosity, volume, etc.) than the bladder and/or filler material in at least one other fluid-filled bladder. Additionally, a quantity of filler material in a fluid-filled bladder relative to at least another fluid-filled bladder can vary, as can a tension induced at a surface of a fluid-filled bladder relative to that of another.

Based on the above descriptions, one having skill in the art will appreciate that the contemplated embodiments are much more expansive than those specifically described herein. Below, some alternative embodiments are described in more detail, but they are likewise set forth for illustrative rather than limiting purposes.

Alternative Embodiments

For aesthetic purposes, one or both of a shoe base material and/or lamina material is/are transparent in an embodiment, while one or both of the filler material and the bladder material includes a pigmenting material (e.g., dye, etc.), rendering a colored fluid-filled bladder visible to the user and/or others.

In an embodiment, an amount of filler material remains beneath a users foot due to a portion of the fluid-filled bladder (and recess) being asymmetrically recessed 'deeper' into the rigid shoe base relative to another portion of the same fluid-filled bladder. The deeper portion is generally, but not exclusively, aligned with a direction of a force applied through a plantarflexed foot, such applied force and fluid-filled bladder being unique to the shoe within which the fluid-filled bladder is designed and disposed.

In at least one embodiment, a fluid-filled bladder is divided internally to form a plurality of individual, sealed chambers, collectively comprising the total internal volume of the bladder. While the filler material in each chamber can be the same throughout the fluid-filled bladder, in an alternative embodiment, the filler material within at least one chamber can be different in at least one characteristic (e.g., material type, viscosity, etc.) than the filler material in at least one other chamber. Additionally, a quantity of filler material in a chamber relative to at least another chamber within a fluid-filled bladder can vary, as can the tension induced at a surface of a fluid-filled bladder corresponding to one chamber relative to another.

When divided into separate chambers, the divisions can be configured along nearly any axis definable within the fluid-filled bladder (e.g., anterior-posterior, lateral-transverse, radiating outwardly from a 'hub', corresponding to anatomical features of the user's foot, corresponding to structural features of the shoe, etc.). Likewise, in another embodiment, a divider between a chamber and at least one other adjacent chamber can include a perforation, allowing filler material to transfer from the one chamber into the other chamber and back in response to an applied force. Such perforation can be sized, configured, and/or located so as to control a rate, amount, and/or path of such responsive fluid transfer.

In an embodiment, a fluid-filled bladder can be retained within a recess formed into the base of a substantially-inclined shoe by use of a fastening device (e.g., screw, nail, rivet, clamp, collar, etc.) configured to engage the fluid-filled bladder and a portion of the shoe (e.g., the base, etc.), rather than or in addition to an adhesive material. In the case of a seamed fluid-filled bladder, the fastening device can pass through and/or otherwise engage a portion of the seam. Alternatively and/or additionally, a structural feature (e.g., a latch, rim, detent, ridge, projection, etc.) may be integrally formed at a portion of the shoe base, configured to retain a fluid-filled bladder within a recess. The retention feature may be disposed entirely or partially within a recess, or wholly outside the recess. In general, an integral structural retention feature is configured to engage a reciprocally-configured portion of the fluid-filled bladder or a structural element (e.g, hinged retainer, ring, clip, etc.) configured to couple with the shoe base and retain the fluid-filled bladder mainly within the recess.

In an embodiment, one or both of a first fluid-filled bladder and a reciprocal recess of a substantially-inclined shoe are configured to enable removal of the first fluid-filled bladder from the recess, and replacement therein by a second 'replacement' fluid-filled bladder. Replacement of a fluid-filled bladder may be desirable in the event of structural failure and/or performance degradation of the first fluid-filled bladder (e.g., due to rupture, etc.), or to accommodate a change in the user's foot (e.g., following surgery or an injury, etc.), or to change the tension of the fluid-filled bladder (e.g., following a notable change in the weight of the user), or for other reasons. One or both of the bladder and/or filler material of the second fluid-filled bladder can vary in at least one characteristic from that of the first fluid-filled bladder. However, the second fluid-filled bladder will generally be similarly configured such that it fits mainly within the recess, and is retainable therein by the same and/or similar means as was the first fluid-filled bladder.

In an embodiment, a total internal volume of a recess is greater than that of a portion of a fluid-filled bladder disposed therein. The greater internal volume can, according to alternative configurations, result from a recess being larger than the fluid-filled bladder in one or more dimensions, or from a secondary recess being formed into an inner surface of and extending from a primary recess. In such embodiments, application of a force upon the fluid-filled bladder will generally cause the fluid-filled bladder to deform in the direction of an unoccupied portion of the volume of the recess before deforming upwardly toward the user's foot.

Embodiments of a fluid-filled bladder for use in a substantially-inclined shoe can be configured according to a wide variety of shapes, generally corresponding to a similarly shaped recess. For example, a recess and/or fluid-filled bladder can be configured approximately as an inverted pyramid in a vertical cross-sectional view, with an apex directed generally downwardly into the base of the shoe. Likewise, a fluid-filled bladder and corresponding recess can be curved across a width of the anterior portion of a foot-engaging shoe surface, to approximately correspond to and/or underlie a curvilinear arrangement of a plurality of metatarsal-phalangeal junctions.

In an embodiment, an exterior of a fluid-filled bladder includes a relatively plush cushioning material integrated and/or coupled therewith. For example, a relative plush material could be a fibrous polyester, a synthetic moleskin, or another similarly textured material, configured to enhance the comfort of, and/or reduce friction with a user's foot. In an embodiment, a lamina disposed at the foot-engaging surface of a substantially-inclined shoe includes an opening formed therein corresponding to (e.g., overlying and exposing therethrough) a fluid-filled bladder, and a plush material covers a surface portion of the fluid-filled bladder itself, serving a similar comfort-enhancing purpose as the lamina. Likewise, in an embodiment, a lamina is entirely absent, but either or both of the foot-engaging surface of the shoe and the exposed surface of the fluid patch include a relatively plush or otherwise comfort-enhancing surface material and/or texture.

In yet another embodiment, the base material of a shoe can be compressible, including that portion surrounding all or some part of a recess formed therein. However, a 'tray' having an inner and outer configuration corresponding to (e.g., conforming to, and/or defining) that of a recess, and formed at least in part of a rigid material, is disposed within the recess. The rigid material of the tray provides the same bladder-deformation-defeating functionality as a rigid base material of a shoe, even though the shoe itself does not have a rigid base material surrounding the recess. Thus, when a fluid-filled bladder is disposed within the recess and tray, and a user's foot applies force to the bladder, the bladder responds upwardly and engages the user's foot in a similar cupping, cradling, and force-spreading fashion as in embodiments where a rigid sole is utilized.

Although the embodiments are primarily directed toward substantially-inclined shoes, an embodiment of the invention also includes a fluid-filled bladder disposed in a recess formed into the substantially plantigrade (e.g., not substantially-inclined) foot-engaging surface of a shoe and extending above that surface. Alternatively, rather than a fluid-filled bladder, a similarly configured, unitary mass of a gel material (e.g., soft, rubbery, resilient polymeric materiel) may be disposed partially above and partially below the foot-engaging surface. In such embodiments, any and/or all other characteristics of the shoe as described herein, other than the inclined-orientation of the foot-engaging surface, may be present.

Advantages of the Invention

Embodiments of the invention provide a method and apparatus, as well as an entire footwear system, configured to reduce both the impact force and cumulative stress applied to a user's feet during normal use of substantially-inclined shoes. The prior art does not contemplate an integrated, recessed, fluid-response system for substantially-inclined shoes with rigid bases.

Rather than providing an energy return system (such as a gas-filled chamber surrounded by a compressible, elastic material) that pushes back against the pressure points of a user's foot, embodiments of the invention yield in response to force applied at the pressure point(s), and responsively rise up, conforming to and supporting a larger surface area of a foot. Such response reduces the cumulative forces applied at the pressure points, delaying and/or mitigating foot fatigue, and reducing the likelihood of cumulative-stress related injuries.

An upward, supporting response is achieved in part due to a fluid-filled bladder being recessed into and surrounded by a rigid base material, rather than a compressible, elastic, resilient base material as in many athletic shoes. The response to an applied force is accommodated almost entirely by the fluid-filled bladder in the embodiments (with the lamina accommodating some applied force), and the rigid base material redirects supportive fluid-filled bladder deformation upward toward portions of a user's foot not projecting downward to the same extent as, more yielding than, or generally surrounding, the pressure points of the foot.

Extending the time-duration of an impact (e.g., rapid deceleration of a moving object) reduces the impact forces imparted to the foot. The high viscosity of the filler material selected for use in the embodiments slows the force-distributing response, extending the time-duration of foot deceleration, thus reducing the impact forces of each foot strike. At the same time, the flowable filler material is able to move about within a bladder, and to conform the bladder to the contour of different areas of a user's foot. None of these effects are collectively achieved by prior art shoe inserts, or by gas-filled bladders in elastic sole materials.

The compressible sole composition of most athletic shoes, initially conveys and temporarily stores the energy of an applied force outwardly into a gas-filled bladder and sole via compression, and then returns that energy to the foot in the same areas (e.g., pressure points) that created the compression. Thus, an athletic shoe having a gas-filled bladder and a compressible sole material applies strong forces to a pressure point twice with each foot strike; once upon first strike of the foot with the ground (thus compressing the compressible sole materials), and again when the compressed materials in the sole rebound from an initially compressed condition. As one having ordinary skill with recognize, this energy return system aids athletic endeavors, which are generally of a limited, relatively short time duration (e.g., tennis game, basketball game, foot race, etc.), but can exacerbate the cumulative-force-related trauma and similar problems suffered by users of substantially-inclined shoes.

By contrast, over the course of a work day and/or after-work-hours social activities, a user may continuously wear a substantially-inclined shoe for 8 or more hours without discomfort of injury. The responsive load-spreading and cradling support of the invented integrated fluid-filled bladder and system provide a superior cumulative stress-reducing result relative to gaseous bladders, and also relative to so-called 'gel' insoles laid atop a foot-engaging surface of a shoe, or even relative to fluid-filled insoles laid atop a foot-engaging surface of a shoe. These benefits are provided entirely without altering the fit characteristics of the shoe, a major shortcoming of prior art insoles which also limits their thickness, and therefore their effectiveness.

Embodiments of the invention provide an integrated, foot-cradling, cumulative-force mitigation system for shoes having a rigid base and a substantially inclined configuration. Typical shoe inserts merely lie atop a foot-engaging surface of a shoe, consuming space between the insole and an upper reducing the space available therein to receive a user's foot, and frequently causing or increasing foot discomfort. However, by contrast, embodiments of the invention do not reduce the space available to receive a user's foot within the shoe.

Rather, a user's foot fits exactly as intended (and as the shoe was designed and manufactured) in a space provided between the foot-engaging surface and an upper, and the fit and comfort of the shoe increases as one or more fluid-filled bladders responsively conform to the contour of a user's foot during use.

Embodiments of the invention provide a plurality of individually responsive fluid-filled bladders across a width of an anterior portion of a substantially-inclined shoe, providing individualized force-responsive support to each of a plurality of pressure points. Likewise, an embodiment provides individualized force-responsive fluid-filled bladders at each of the ball and heel of a users' foot. Thus, the foot-damaging aspects of the orientation and concentration of forces applied between a foot and the rigid foot-supporting structure inherent to most substantially-inclined shoes, and other physiological considerations related to a plantarflexed foot in such shoes, are all effectively utilized in the solution provided by the invented embodiments.

Because a fluid-filled bladder is integrated not only physically with a substantially-inclined shoe, but also into the design and unique configuration of the shoe, the fluid-filled bladder is configured in embodiments not only to closely correspond with the plantarflexed condition that particular shoe specifically induces in a user's foot, but also with the specific orientation of forces resulting from such configuration. No 'off-the-shelf, after-market' shoe insole existing is so configured, since each is generally provided as a 'one style fits all' product, and therefore don't closely accommodate the tremendous variety of both substantially-inclined, aesthetically-oriented shoes, and the feet disposed therein.

Embodiments of the invention maintain an amount of a filler material between the pressure point(s) of a user's foot and the rigid material of a shoe base, preventing the pressure points from 'bottoming out'. So-called 'gel' insoles (e.g., as produced by DR. SCHOLLS, etc.) tend to bottom out at a maximum level of compression they were designed to accommodate, and provide no cushioning benefits beyond that point as dynamic forces increase. Such insoles generally cannot be made thicker, to accommodate higher forces, since thickening the insole would further constrict available space within a user's shoe. The described inventive embodiments are not so limited. Therefore, the embodiments prevent bottoming out, and maintain effective cushioning of a foot, throughout a much greater range of dynamic forces during use.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

It is further intended that any other embodiments of the present invention that result from any changes in application or method of use or operation, configuration, method of manufacture, shape, size, or material, which are not specified within the detailed written description or illustrations contained herein yet would be understood by one skilled in the art, are within the scope of the present invention.

Finally, those of skill in the art will appreciate that the invented method, system and apparatus described and illustrated herein may be implemented using any of numerous configurations and/or materials, or any suitable combination thereof. Preferably, embodiments of the method, system, and apparatus described herein are implemented in a combination thereof, for purposes of low cost and flexibility.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

I claim:

1. A pressure-responsive footwear system, comprising:

a substantially-inclined shoe having a posterior portion and an anterior portion and a middle portion disposed therebetween, and further having a foot-supporting portion comprising:

a unitary, rigid sole portion that is generally incompressible in response to a force applied by a user's foot during use, wherein:

the rigid sole portion is either a midsole, or an outsole, or a unitary combination of a midsole and an outsole;

the rigid sole portion includes and extends for at least a first thickness between each of an upwardly-orientated foot-engaging surface and a downwardly-orientated ground-engaging surface, the foot-engaging surface includes a first outer boundary, and either or both of a posterior portion and a middle portion of the foot-engaging surface is inclined at an angle equal to or greater than approximately fifteen degrees (15°) along an approximately anterior-posterior axis, a first recess formed into the foot-engaging surface of the rigid sole portion and positioned within the outer boundary thereof, the recess presenting an opening at the foot-engaging surface and further extending into but not fully through the rigid sole portion, wherein:

a cross-sectional depth profile of the recess is asymmetric along an anterior-posterior plane extending through the recess, a deeper first portion or the recess is disposed closer to the anterior end of the shoe than is a second shallower portion of the recess, and inner surfaces of the recess are concavely curved rather thin angular;

a first leak-resistant, flexible bladder disposed mainly within and conforming dimensionally relative to an inner configuration of the recess;

a volume of relatively viscous filler material disposed within and filling the bladder, wherein:

the filler material imparts a suitably high tension at a surface of the bladder, a portion of the bladder extends above the foot-engaging surface immediately surrounding the opening of the recess, and in response to a three applied downwardly by a portion of a user's foot upon a portion of the bladder during use, the rigid sole portion prevents downward and lateral displacement of the filler material, and instead redirects displacement of the filler material upwardly toward portions of the user's foot located adjacently to the force-applying portion of the user's foot.

2. The footwear system of claim 1, further comprising a lamina disposed at, and having a second outer boundary substantially conforming with the first outer boundary of, a portion of the foot-engaging surface.

3. The footwear system of claim 1, wherein a volume of the first recess is greater than a volume consumed by a portion of the first bladder disposed therein.

4. The footwear system of claim 2, wherein the lamina comprises a resilient material configured compliantly to respond to an applied force.

5. The footwear system of claim 1, wherein the filler material is one or more selected from among a liquid, a flowable polymeric material, and a viscoelastic fluid, and possesses a kinematic viscosity found within a range of one centistoke to one hundred thousand centistokes (1-100,000 cSt.).

6. The footwear system of claim 1, wherein a kinematic viscosity of the filler material is found within a range of ten thousand centistokes to sixty thousand centistokes (10,000-60,000 cSt.).

7. The footwear system of claim 1, wherein the filler material comprises polydimethylsiloxane.

8. The footwear system of claim 1, wherein the first bladder is securely retained within the recess by one or more fastening means selected from among an adhesive material disposed between the bladder and an inner surface of the recess, a fastening device configured to engage the bladder and the foot-supporting portion, and an integrally-formed structural feature of the foot supporting portion.

9. The footwear system of claim 1, wherein the first bladder retained within the first recess is removable therefrom and replaceable with another similarly configured replacement bladder.

10. The footwear system of claim 1, wherein the first bladder includes two or more internal chambers, each comprising a portion of a total internal volume of the bladder.

11. The footwear system of claim 1, further comprising:

an additional recess formed at and extending below a separate portion of the foot-engaging surface relative to the first recess; and a second leak-resistant, flexible bladder disposed mainly within and conforming dimensionally relative to an inner configuration of the additional recess; and a volume of relatively viscous filler material disposed within the second bladder, wherein the filler material imparts a suitably high tensile stress at a surface of the second bladder, and a surface of the second bladder extends above the foot-engaging surface immediately surrounding the opening of the recess.

12. The footwear system of claim 1, wherein two or more fluid-filled bladders are asymmetrically arranged within the foot-supporting portion to underlie either or both of a metatarsal-phalangeal junction and a calcaneus bone when the shoe is worn by a human user.

13. The footwear system of claim 1, wherein the bladder comprises a material selected from among polyvinyl chloride, silicone, neoprene, polyurethane, and a fluorocarbon-based membrane.

14. The footwear system of claim 1 wherein the first thickness of the rigid sole portion is equal to or greater than one-quarter inch (¼").

15. The footwear system of claim 1, wherein the first bladder, when disposed within the recess, resists both rupture and collapse in response to a downwardly applied force producing up to two hundred pounds per square inch (200 p.s.i.) of externally applied pressure.

16. The footwear system of claim 1, wherein a first portion of the bladder extends more deeply through the first portion of the recess than does a second portion of the bladder through the second portion of the recess, the first portion of the bladder being, aligned with a direction of force applied by a plantar-flexed foot disposed upon the foot-engaging surface of the shoe.

17. The footwear system of claim 1, wherein the first fluid-filled bladder further comprises a rupture-resistant textile either separately surrounding the exterior of the leak-resistant bladder, or laminated at an exterior surface of the leak-resistant bladder, or embedded within a leak-resistant material of the bladder, or any suitable combination thereof.

18. A shoe, comprising:

a rigid sole portion including a ground-engaging surface, an opposing foot-engaging surface, and a rigid foot-supporting material disposed therebetween, wherein:

the rigid sole portion is either a midsole, or an outsole, or a unitary combination of a midsole and an outsole;

a first thickness of an anterior portion of the rigid sole portion is equal to or greater than one quarter inch, and one or both of a posterior portion and a middle portion of the foot-engaging surface is inclined at an angle equal to or greater than approximately fifteen degrees (15°) along an approximately anterior-posterior axis of the shoe;

a recess formed into the rigid sole portion with an opening thereto presented at the foot-engaging surface and having an asymmetrical depth profile, wherein;

a first portion of the recess is formed to a greater depth into the rigid sole portion of the shoe than is at least a second portion of the recess, the first portion of the recess is disposed more toward the anterior of the shoe than is the second portion of the recess, the recess does not extend fully through the rigid sole portion from the opening at the foot-engaging surface to the ground-engaging surface, and adjacent inner surfaces of the recess are coupled by a curved junction disposed therebetween;

a replaceable, force-deformable bladder disposed mainly within the recess, wherein a portion of the bladder extends downwardly into the recess below the foot-engaging surface and another portion thereof protrudes upwardly through the opening and above the foot-engaging surface;

a volume of relatively viscous filler material disposed within the bladder, wherein:

the filler material imparts a suitably high tension at a surface of the bladder, a portion of the bladder extends above the foot-engaging surface immediately surrounding the opening of the recess, and in response to a force applied downwardly by a portion of a user's foot upon a portion of the bladder during use, the rigid sole portion prevents downward and lateral displacement of the filler material, and instead redirects displacement of the filler material upwardly toward portions of the user's foot located adjacently to the force-applying portion of the user's foot; and an upper portion coupled with the rigid sole portion and configured to receive and retain a user's foot in position relative to both the foot-engaging surface and the cushioning device, wherein the bladder underlies either or both of a metatarsal-phalangeal junction or a posterior portion of the calcaneus bone of the foot.

19. The shoe of claim 18, wherein the relatively viscous filler material comprises either of a gel or a liquid disposed therein.

20. The shoe of claim 19, further comprising a flexible lamina disposed at the foot-engaging surface and overlying the bladder.

21. The shoe of claim 18, wherein an inner surface of the recess comprises one or both of a rigid material of the rigid sole portion or a tray disposed within the recess and formed a least in part of a rigid material.

* * * * *

UNITED STATES PATENT AND TRADEMARK OFFICE

CERTIFICATE OF CORRECTION

PATENT NO. : 8,490,297 B2
APPLICATION NO. : 12/287593
DATED : July 23, 2013
INVENTOR(S) : Ginger Guerra It is certified that error appears in the above-identified patent and that said Letters Patent is hereby corrected as shown below:

In the Claims:

Column 24:
at line 49 replace "in response to a three" with: --in response to a force--

Signed and Sealed this
Third Day of September, 2013

Teresa Stanek Rea
*Acting Director of the United States Patent and Trademark Office*